US005673911A

United States Patent [19]

Loftus et al.

[11] Patent Number: 5,673,911

[45] Date of Patent: Oct. 7, 1997

[54] DEVICE FOR FEEDING SHEET MATERIAL

[75] Inventors: Geoffrey Loftus, Heidelberg; Gotthard Schmid, Malsch, both of Germany

[73] Assignee: Heidelberger Druckmaschinen AG, Heidelberg, Germany

[21] Appl. No.: 552,131

[22] Filed: Nov. 2, 1995

[30] Foreign Application Priority Data

Nov. 2, 1994 [DE] Germany ..... 44 39 092.0

[51] Int. Cl.[6] ..... B65H 5/06

[52] U.S. Cl. ..... 271/273; 271/277

[58] Field of Search ..... 271/273, 274, 271/277, 3.21, 11

[56] References Cited

U.S. PATENT DOCUMENTS

| | | | |
|---|---|---|---|
| 3,210,074 | 10/1965 | Miaskoff | 271/274 |
| 3,790,159 | 2/1974 | Hatzmann et al. | 271/277 |
| 3,833,214 | 9/1974 | Zawiski et al. | 271/273 |
| 4,353,274 | 10/1982 | Shimizu | 271/273 |
| 4,607,837 | 8/1986 | Pierce | 271/273 |
| 4,630,815 | 12/1986 | Peterson et al. . | |
| 4,848,765 | 7/1989 | Torii | 271/274 |
| 4,892,301 | 1/1990 | Barrois et al. | 271/274 |

FOREIGN PATENT DOCUMENTS

| | | | |
|---|---|---|---|
| 0658503 | 6/1995 | European Pat. Off. . | |
| 2357617 | 6/1974 | Germany . | |
| 2552277 | 6/1977 | Germany . | |
| 2942525 | 4/1981 | Germany . | |
| 2313150 | 12/1981 | Germany . | |
| 3630384 | 3/1987 | Germany . | |
| 4039146 | 6/1992 | Germany . | |
| 0111337 | 8/1980 | Japan | 271/273 |
| 0022230 | 2/1983 | Japan | 271/273 |
| 0098540 | 4/1989 | Japan | 271/274 |
| 0265838 | 10/1990 | Japan | 271/273 |
| 404094351 | 3/1992 | Japan | 271/273 |
| 1014671 | 12/1965 | United Kingdom . | |
| 1286964 | 8/1972 | United Kingdom . | |
| 2175288 | 11/1986 | United Kingdom . | |

*Primary Examiner*—H. Grant Skaggs

*Attorney, Agent, or Firm*—Herbert L. Lerner; Laurence A. Greenberg

[57] ABSTRACT

Device for feeding single-sheet material to a cylinder accepting the single-sheet material, with feed channels to which, respectively, at least one friction-roller set is assigned, the friction-roller set being mounted so as to be adjustable between a press-on position and a lift-off position, and being insertable into the feed channels cyclically with a feeding of sheet material, includes at least one swivelable transport member disposed adjacent the feed channels and, located at the feed channels downstream from the swivelable transport member, as viewed in sheet transport direction, sheet-guiding elements for maximizing accuracy of the feeding of the sheet material into sheet-holding elements of a sheet-guiding cylinder.

12 Claims, 3 Drawing Sheets

DEVICE FOR FEEDING SHEET MATERIAL

BACKGROUND OF THE INVENTION

Field of the Invention

The invention relates to a device for feeding single-sheet material to a cylinder accepting the single-sheet material, with feed channels to which, respectively, at least one friction-roller set is assigned, the friction-roller set being mounted so as to be adjustable between a press-on position and a lift-off position.

The German Published Non-Prosecuted Patent Application DE-OS 23 57 617 discloses a device for feeding and aligning single sheets. Positioned in advance of or before an electrostatic drum is a direction-reversing device which, when passed, imparts an approximately 180° change of direction to the single sheets. The single sheets to be transported are aligned by a swivelable alignment stop while they pass the direction-reversing device and before they reach an electrostatic drum. The transport speed of the single sheets is limited by the alignment operation which takes place during the feeding of the single sheets.

The published German Patent Document DE 23 13 150 C3 discloses a sheet-feeding arrangement for sheet-fed rotary printing presses. Disposed in the feed table before or in advance of front lays is a first linear conveyor, after or following which, a second linear conveyor is positioned. Both linear conveyors cooperate in such a manner that the first linear conveyor ceases to have an effect the instant the sheet has been gripped by the second linear conveyor. The published German Patent Document DE 29 42 525 A1 discloses a device for separating and separately further transporting two superimposed sheets formed of paper or the like. Bendable sectoral straps are assigned to a suction drum having two suction sectors on the circumference thereof and are movable onto the circumference of the suction drum and, in turn, cover suction openings formed in the latter. In this manner, it is possible temporarily to seal non-required suction openings without adversely affecting the separating and transporting function of the suction openings when needed.

The published German Patent Document DE 36 30 384 A1 discloses a device for feeding originals to a copier having both transport-belt arrangements and also pairs of transport rollers for transporting copies. By means of a number of sheet sensors, it is possible to determine in which transport path a copy may actually be found. A somewhat triangular guide body, respectively, limits a multiplicity of possible transport paths for the individual copies.

Finally, the published German Patent Application DE 40 39 146 A1 discloses a device for feeding sheet material into a further-conducting sheet-transport system of an apparatus. In this device of the prior art, an upper friction roller cooperates with the underside of a feed duet and a lower friction roller cooperates with the underside of a further feed duet. The friction rollers, respectively, have a lever arrangement driven by a common control-cam element so that an alternatively cycled conveyor or transport movement is permitted in the individual feed channels. In order to produce a transport movement, the copies are gripped by the friction rollers and are pressed against the non-moving underside of the feed channel which, in the case of extremely thin papers of low weight, results in transport problems, especially since there is only one transport location in the form of a friction-roller set for each feed channel, in the arrangement shown. The feeding movement is applied to the sheet material at only one location, which can possibly result in a crumpling of the material in the feed channels due to an absence of devices for accepting the transported material.

Proceeding from the prior art as outlined hereinbefore, it is an object of the invention to provide a device for feeding sheet material which ensures a reliable or safe passage of paper for a multiplicity of print carriers or stocks, without any necessity for a feed drum or pregrippers.

SUMMARY OF THE INVENTION

With the foregoing and other objects in view, there is provided, in accordance with the invention, a device for feeding single-sheet material to a cylinder accepting the single-sheet material, with feed channels to which, respectively, at least one friction-roller set is assigned, the friction-roller set being mounted so as to be adjustable between a press-on position and a lift-off position, and being insertable into the feed channels cyclically with a feeding of sheet material, comprising at least one swivelable transport member disposed adjacent the feed channels and, located at the feed channels downstream from the swivelable transport member, as viewed in sheet transport direction, sheet-guiding elements for maximizing accuracy of the feeding of the sheet material into sheet-holding elements of a sheet-guiding cylinder.

In accordance with another feature of the invention, the swivelable transport member is engageable and disengageable by a roller/cam drive through the intermediary of at least one transmission member.

In accordance with a further feature of the invention, the sheet material have infeed paths in the feed channels, the sheet guiding elements partly passing through the feed channels and having an influence on the infeed paths of the sheet material.

In accordance with an added feature of the invention, the sheet-guiding elements are movable both in and opposite to the transport direction of the sheet material.

In accordance with an additional feature of the invention, the sheet-guiding elements are movable perpendicularly to the sheet material.

In accordance with yet another feature of the invention, the sheet-guiding elements are inclinable in a direction transverse to the sheet transport direction for tautening the sheet material.

In accordance with yet a further feature of the invention, the sheet-guiding elements being insertable to different depths in the feed channels for varying the shape of the leading edge of the sheet material.

In accordance with yet an added feature of the invention, the leading edge of the sheet material is deformable convexly by engagement thereof with the sheet-guiding elements.

In accordance with yet an additional feature of the invention, the leading edge of the sheet material is deformable concavely by engagement thereof with the sheet-guiding elements.

In accordance with still another feature of the invention, the sheet-guiding elements are formed as air nozzles passing into the feed channels at an inclination.

In accordance with still a further feature of the invention, the sheet-guiding elements are formed as spring-loaded sheetmetal lips pressable into the feed channels.

In accordance with a concomitant feature of the invention, sheet-guiding elements are formed as brushes.

According to the invention, it is thus possible for sheet material to be transported continuously from a withdrawal or removal location disposed below a transfer location, without crumpling or damaging the material, because the swivelable transport members are able to engage surfaces of driven transport members. The sheet-guiding elements, which are disposed following or downstream of the transport members, when viewed in the sheet-material transport direction, act directly on the sheet material, tauten it and effect the transfer of the sheet material in a defined position at the transfer location. It is thus possible for sheets even of minimum size to be transported and transferred to the cylinder grippers, without any requirement for pregrippers, swing grippers or an additional transfer drum. Because continuous transport is ensured by the sections of the feed channel, thin materials do not swell out when the vertical inclination of the feed channel increases prior to the transfer to a cylinder. By means of the invention, it is possible to achieve a drastic reduction in friction; furthermore, the energy required for implementation of a suction-air transport can be saved.

As a further development of the concept upon which the invention is based, the swivelable transport members, respectively, may be engageable and disengageable by a roller/cam drive through the intermediary of transmission members. It would also be conceivable to employ a common cam drive for both timing-roller sets. In order to adapt to varying thicknesses of printing stock, it is possible, concerning transmission members, to adapt the insertion depth of the sheet-guiding elements into the feed channels. This might also be accomplished by computer control through the intermediary of servomotors, it being necessary to store the relevant parameters on a printing stock-specific basis, with the machine parameters being preset automatically on the feed channels. The sheet-guiding elements, which partially pass through or penetrate the surfaces of the feed channels, influence the infeed or entry path of the sheet material. Thus, the sheet-guiding elements are movable both in and opposite to the transport direction of the sheet material. In conjunction with a variation of the insertion depth, therefore, it is possible to implement the selective deformation of the leading edge of the sheet, whether it is curved convexly or concavely. An inclination of the sheet-guiding elements in the transverse direction may improve the tautening of the sheet in the case of thin sheet material. Besides having the sheet-guiding elements formed as rubber discs, it would also be conceivable for them to be formed as ball bearings, brush-wheels or brushes. The sheet-travel path might equally be influenced by spring-loaded, engageable sheet-metal lips or air nozzles, which may be installed at an inclination in the feed channels and which blow in blast air in a time-controlled manner.

Other features which are considered as characteristic for the invention are set forth in the appended claims.

Although the invention is illustrated and described herein as embodied in a device for feeding sheet material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
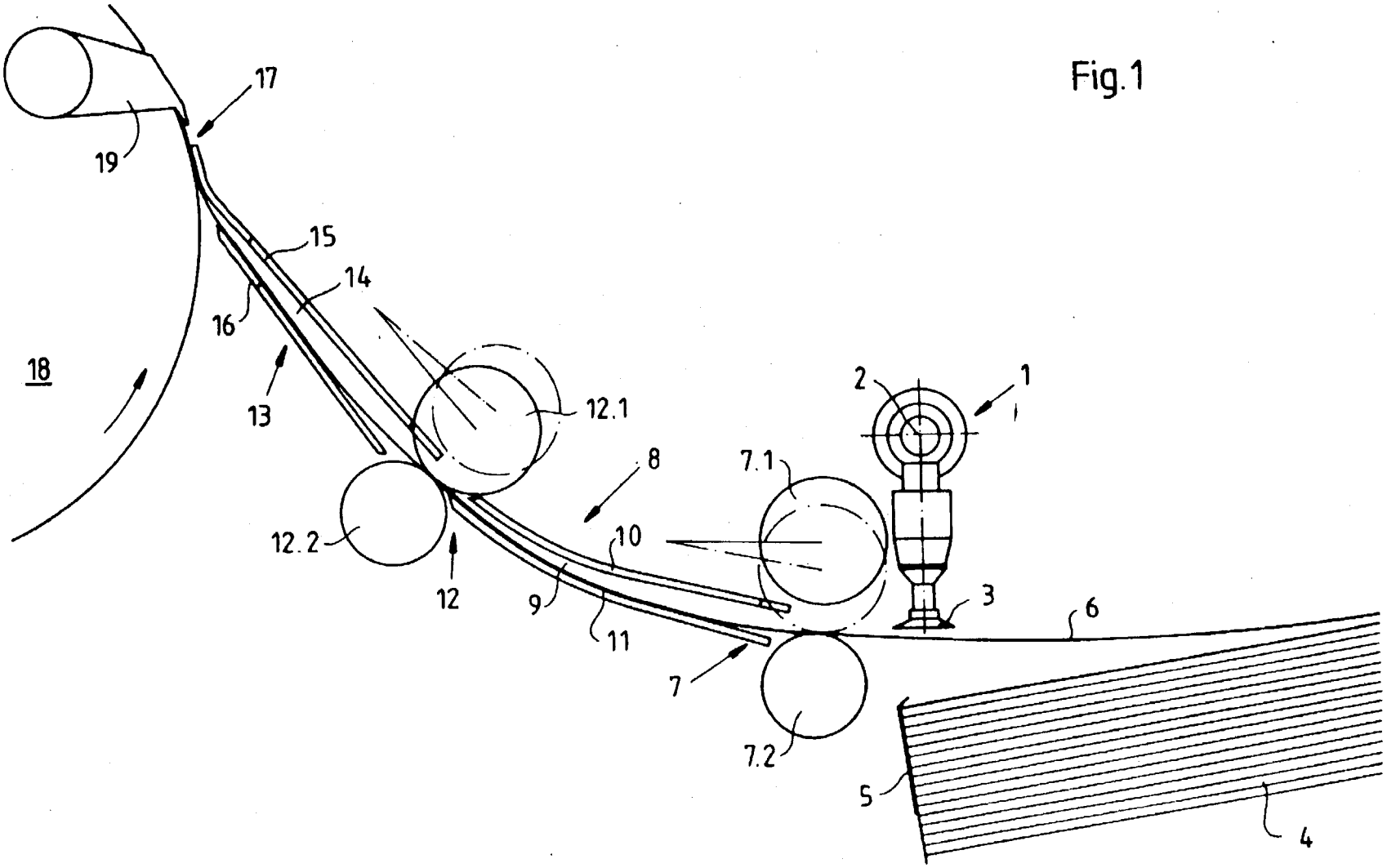
FIG. 1 is a diagrammatic side elevational view of a first embodiment of the sheet-material feeding device with feed channels according to the invention.

Referring now to the drawings and, first, particularly to FIG. 1 thereof, there is shown therein an embodiment for feeding sheet material in accordance with the invention which has a transport-path configuration extending from a lower-disposed withdrawal or receiving site 4 to a higher-disposed transfer location 17.

Suckers 3 are attached to a suction bar 1 which is movable about a swivel axis 2. The suckers 3 lift sheet material 6 from a sheet pile 4 and feed it to a first timing-roller pair 7. The first timing-roller pair 7 is formed of a swivelable upper transport member 7.1 and a permanently driven lower transport member 7.2 having a circumferential surface projecting into a first feed section 8, which is limited by an upper guide plate 10 and a lower guide plate 11. The upper transport member 7.1 is movable from an upper position thereof into a position wherein it is in engagement with the lower transport member 7.2. The engaged position of the upper transport member 7.1 is indicated in phantom.

The sheet material 6 is gripped by the first timing-roller pair 7 and is transported into the feed section 8. The feed section 8 has a cross section 9 which narrows towards a second transport location, namely, a second timing-roller pair 12. The second timing-roller pair 12 is formed of an upper engageable and disengageable transport member 12.1 and a lower permanently driven transport member 12.2. The second timing-roller pair 12 is adjoined by a further feed section 13 which is engaged more steeply with a circumference or outer cylindrical surface of a sheet-conducting cylinder 18 accepting the sheet material 6 at a transfer location 17. The further feed section 13 is formed of an upper and a lower guide plate 15 and 16, respectively, defining a cross section 14 therebetween which narrows towards the transfer location 17. At the transfer location 17, the sheet material 6 is conveyed into opened cylinder grippers 19 of the cylinder 18.

A swiveling mechanism, which is described in detail hereinbelow, ensures that the upper transport member 7.1 of the first timing-roller pair 7 does not release the sheet material 6 until the sheet material 6 has been transferred safely and without loss of register to the second timing-roller pair 12. The second timing-roller pair 12, in turn, does not release the sheet material 6 to be fed to the sheet-conducting cylinder 18 until the sheet material 6 has been gripped in accurate register at the transfer location 17 by the cylinder grippers 19.

Figure 2:
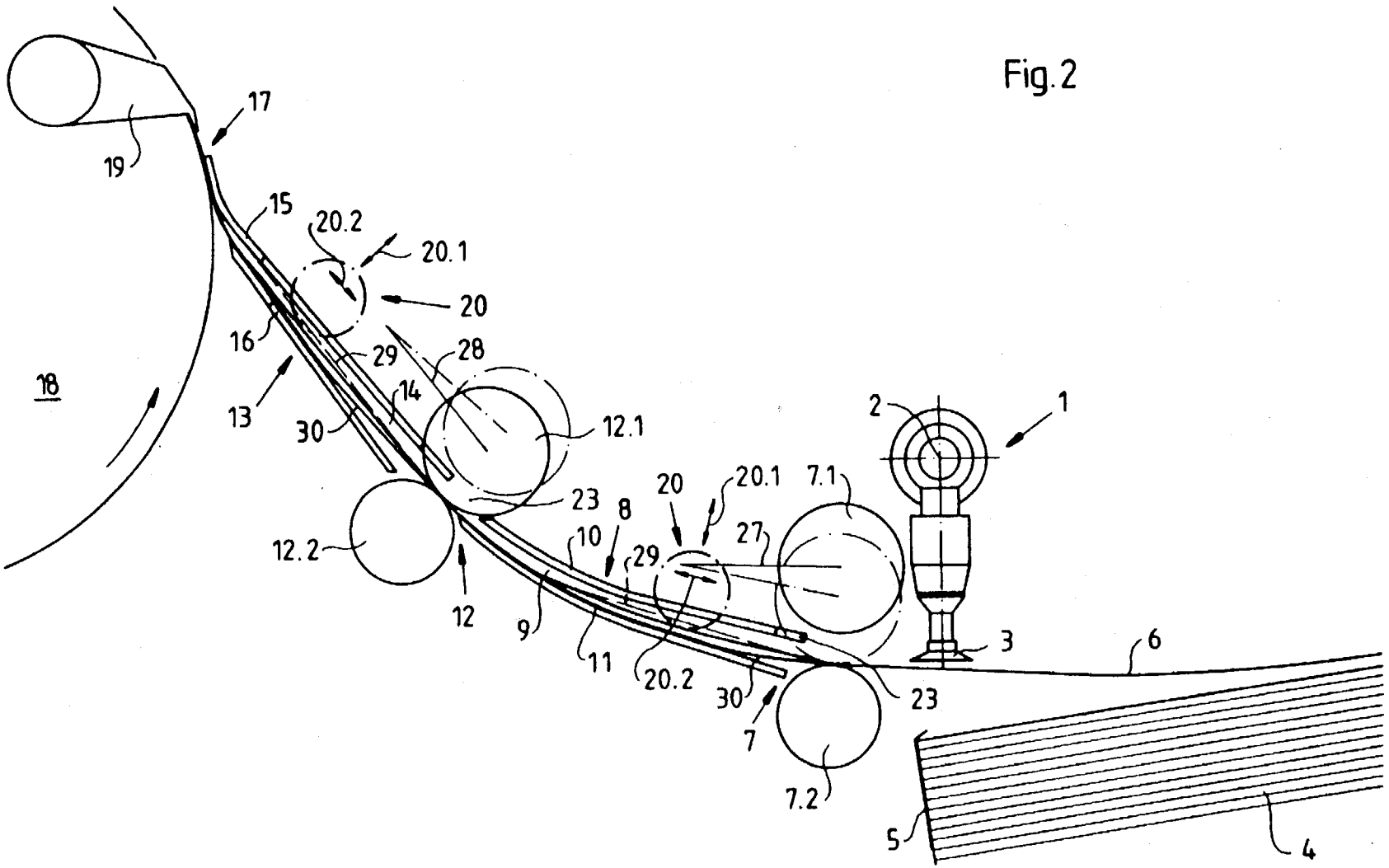
FIG. 2 is a view like that of FIG. 1 of a second embodiment the device showing a transport-path configuration for sheet material with sheet-guiding elements and infeed paths for different materials.

FIG. 2 shows a transport-path configuration with sheet-guiding elements and infeed paths for thick and thin sheet materials.

In this illustrated embodiment of the invention, as viewed in the transport direction of the sheet materials, sheet-guiding elements 20 are disposed above the feed sections 8 and 13 following or downstream of the first and second timing-roller sets 7 and 12, respectively. The sheet-guiding elements 20, shown herein as rubber rollers, pass through the upper guide plates 10 and 15, respectively, of the feed sections 8 and 13, respectively, so that they are able to act directly on the sheet material 6 to be transported. The sheet-guiding elements 20 are adjustably movable both in and opposite to the transport direction as indicated by the double arrows 20.2. Furthermore, the sheet-guiding elements 20 are also movably adjustable in the insertion depth thereof downwardly and upwardly in the feed sections 8 and 13 as indicated by the double arrows 20.1. The adjusting-movement operations, as indicated by the double arrows 20.1 and 20.2, may be effected both manually and through the intermediary of servomotors. In the case of the movement by servo-motors, it is possible, for example, for such servomotors to be moved under computer control to specific positions, for example, as a function of characteristic parameters stored in the memory of the computer. Such parameters may be, for example, the sheet size or format, the weight of the sheet, the material thickness, and so forth.

Instead of being formed as rubber wheels, the sheet-guiding elements 20 may also be formed as ball-bearing races, brush-wheels or pencil-shaped brushes. It would also be conceivable for them to be constructed in the form of spring-loaded sheetmetal lips or air nozzles inserted into the guide plates of the feed sections. With sheet-guiding elements of such construction, it would be possible, for example, if the wheels were inclined, to tauten the sheet material transversely to the transport direction. It would also be possible to achieve a convex or concave deformation of the leading edge of the sheet.

FIG. 2 shows an infeed path 30 for thinner sheet material. The sheet material rests almost entirely on the lower guide plates 11 and 16, so that, in order to have an effect upon the sheets, the sheet-guiding elements 20 should be positioned as closely as possible to the lower guide plates 11 and 16. The driven transport members 7.2 and 12.2 also lie in a plane with the lower guide plates 11 and 16, respectively, in order to prevent crumpling, for example, of thin material. In the processing of thicker printing stocks which, due to the inherent stiffness thereof, describe an infeed path 29, for example, the sheet material 6 lies approximately centrally in the feed channels 8 and 13. In the processing of thicker printing stocks, the sheet-guiding elements 20 are inserted more deeply into the feed channels 8 and 13 in order to move the sheet material 6 nearly on the path of thinner sheets. This ensures that, after passing the sheet control 21 (note FIG. 3), the sheet material always traverses the same distance to the transfer location 17. Thus, a precisely defined angular position of the machine, with reference to the zero position thereof, and a precise instant of transfer are defined.

By the engagement of the sheet-guiding elements, sheets of identical thickness having paths which differ from one another due to a shaped leading edge are also prevented from entering into the cylinder grippers 19 at different instants of time. Accordingly, the position of the sheet material 6 in the cylinder grippers 19 would not be defined, and this would have an effect upon the printed product.

Figure 3:
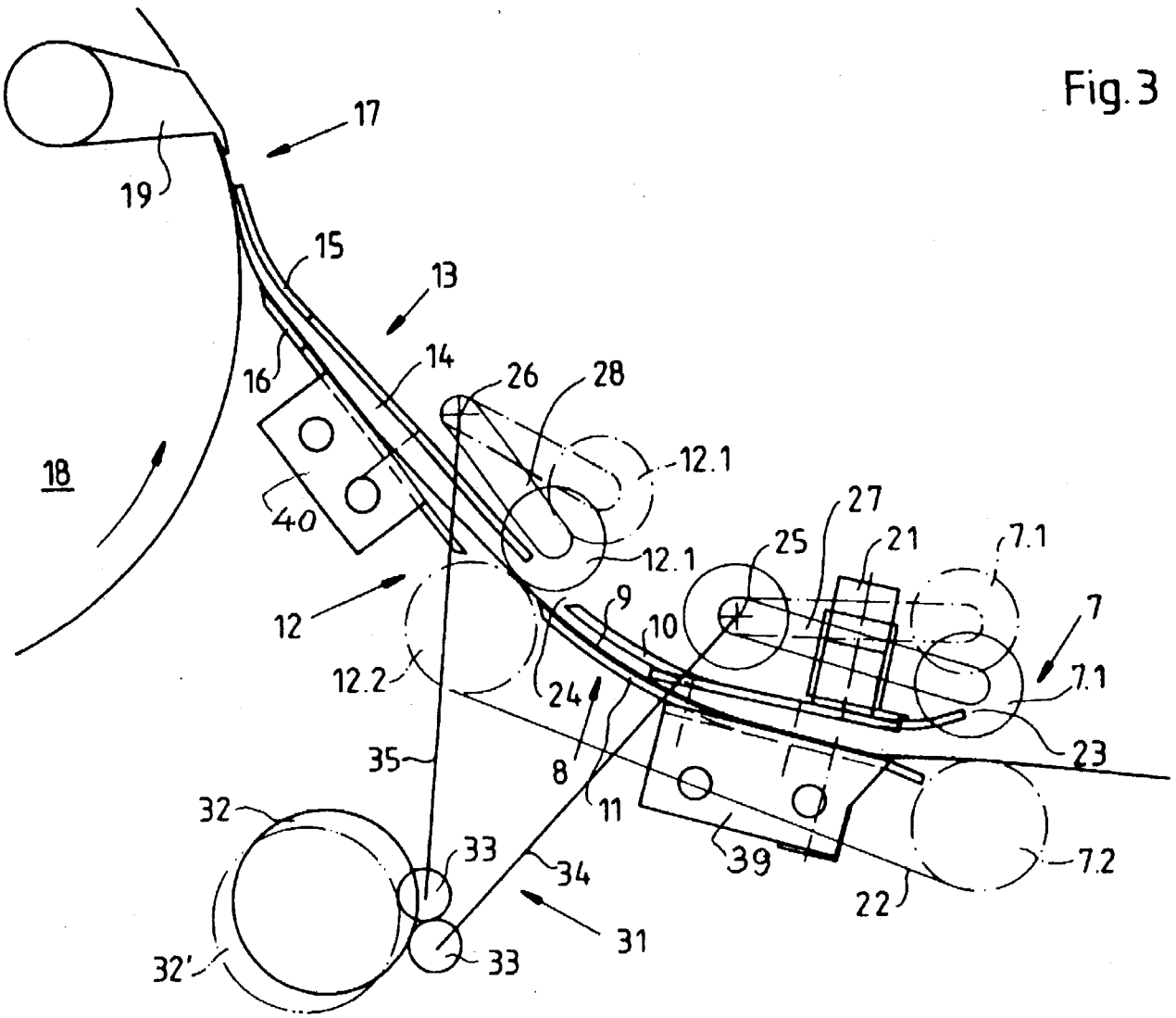
FIG. 3 is a view like those of FIGS. 1 and 2 of a third embodiment of the device according to the invention, showing a transport-path construction with commonly driven transport members located below the feed channels.

The swivelable transport members 7.1 and 12.1 mounted on respective transmission members 27,28, shown in the form of swivel levers in FIG. 3, are inserted through insertion openings 23, 24 into the feed sections 8 and 13. The insertion openings 23 and 24 are defined openings, the number of which is matched to the number and distribution of the sheet sizes or formats. They are distributed across the width of the feed sections 8 and 13, because the transport members 7.1 and 12.1 are displaceable in parallel, as shown in FIG. 3, on swivel shafts 25 and 26 thereof, depending upon the sheet size or format which is to be processed.

The embodiment of the invention shown in FIG. 3 has different feed sections 8 and 13. According to this representation, the lower transport members 7.2 and 12.2 are provided with a timing-roller drive 22, so that the outer cylindrical surfaces thereof rotate at identical speed. The driven transport members 7.2 and 12.2 are disposed below the guide plates 11 and 16, respectively, and do not necessarily need to be in the form of rollers. It would also be conceivable to employ a belt-shaped conveyor or transport member surrounding the lower guide plates 11 and 16. The lower guide plates 11 and 6 are supported by mountings 39 and 40. The levers 27 and 8, which are swivelable about the transmission members or swivel shafts 25 and 26, move the transport members 7.1 and 2.1 into the positions thereof represented in phantom. The first feed section 8 is furnished with a sheet control 21, which detects mis-fed sheets. The specific construction of this control device 21, however, forms no part of the invention of the instant application, and may be of any suitable conventional type.

It can be seen from this representation that the swivel shafts 25 and 26 on which, in turn, the swivel levers 27 and 28 are mounted are moved by transmission members or arms 34 and 35, respectively. The arms 34 and 35 are provided at the lower ends thereof, as viewed in FIG. 3, with rollers 33, which roll on a bearing surface of a cam 32. In the interest of clarity, only one of the cams is shown in FIG. 3. It would, however, also be possible to implement the timed engagement and disengagement movement of the upper transport members 7.1 and 12.1 into the feed sections 8 and 13 and back out of the latter by using a drive common to both transmission members 34 and 35. It would also be conceivable to employ a drive using separate motors.

Through suitable contours of the control cams 32, assurance is provided that the arm 34 produces a rotation of the swivel shaft 25 which, in turn, brings the swivel lever 27 with the transport member 7.1 into engagement with the revolving surface of the driven transport member 7.2. This is performed at the instant at which a sheet which has been accepted from the suckers 3 of the suction bar 1 is located between the transport members 7.1 and 7.2. When the timing roller 7.1, which is rotatably mounted on the swivel lever 27, comes into engagement with the driven transport members 7.2, the sheet material is transported into the feed section 8, the cross-sectional area 9 of which continuously decreases up to the second transport location 12. The instant the sheet material 6 has been gripped by the transport members 12.1 and 12.2, the transport members 7.1 and 7.2 release the material due to the contours of the control cams 32. The sheet material is then transported into the feed section 13 by the transport members 12.1 and 12.2. The instant the sheet material 6 has arrived at the transfer location 17, it is accepted by the sheet-conducting cylinder 18. At this instant, the sheet material 6 is released by the second timing-roller pair 12 which then, in turn, accepts a new sheet which has been released by the first timing-roller pair 7.

Through suitable contours of the control cam 32, or through suitable energizing periods of servomotors, guidance of sheet material through the feed sections 8 and 13 is realizable.

The sheet-guiding elements are placed after or downstream from the first and second timing-roller pairs 7 and 12, respectively, where they act upon the sheet material 6 so that the accuracy with which the sheet material 6 is fed into the cylinder grippers 19 of the sheet-conducting cylinder 18 is at a maximum during the passage thereof through the feed sections 8 and 13. It is thus possible for the sheet material 6 to be transferred at a well defined instant of time and in a well defined position. Transport from the sheet pile 4 to the transfer location 17 is ensured even in the case of sheet material 6 of small format or size.

We claim:

1. Device for feeding single-sheet material to a cylinder accepting the single-sheet material, which comprises: a plurality of feed channels and at least one friction-roller set assigned to each of said feed channels, said friction-roller set being mounted so as to be adjustable between a press-on position and a lift-off position, and being insertable into a respective one of said feed channels cyclically with a feeding of sheet material, and at least one sheet-guiding element for maximizing accuracy of the feeding of the sheet material into sheet-holding elements of a sheet-guiding cylinder, said sheet-guiding element being disposed at said feed channels downstream from said friction roller set, as viewed in sheet transport direction.

2. Device according to claim 1, wherein said friction-roller set includes a swivelable transport member which is engageable and disengageable by a roller/cam drive through the intermediary of at least one transmission member.

3. Device according to claim 1, wherein the sheet material have infeed paths in the feed channels, said sheet guiding elements partly passing through the feed channels and having an influence on said infeed paths of the sheet material.

4. Device according to claim 1, wherein said sheet-guiding elements are movable both in and opposite to the transport direction of the sheet material.

5. Device according to claim 1, wherein said sheet-guiding elements are movable perpendicularly to the sheet material.

6. Device according to claim 1, wherein said sheet-guiding elements are inclinable in a direction transverse to said sheet transport direction for tautening the sheet material.

7. Device according to claim 5, wherein said sheet-guiding elements are insertable to different depths in the feed channels for varying the shape of the leading edge of the sheet material.

8. Device according to claim 7, wherein the leading edge of the sheet material is deformable convexly about said sheet-guiding elements by engagement thereof with said sheet-guiding elements.

9. Device according to claim 7, wherein the leading edge of the sheet material is deformable concavely about said sheet-guiding elements by engagement thereof with said sheet-guiding elements.

10. Device according to claim 1, wherein said sheet-guiding elements are formed as air nozzles passing into the feed channels at an inclination.

11. Device according to claim 1, wherein said sheet-guiding elements are formed as spring-loaded sheetmetal lips pressable into the feed channels.

12. Device according to claim 1, wherein said sheet-guiding elements are formed as brushes.

* * * * *